US007819629B2

(12) United States Patent
Liang

(10) Patent No.: US 7,819,629 B2
(45) Date of Patent: Oct. 26, 2010

(54) BLADE FOR A GAS TURBINE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 905 days.

(21) Appl. No.: 11/707,227

(22) Filed: Feb. 15, 2007

(65) Prior Publication Data

US 2009/0232660 A1 Sep. 17, 2009

(51) Int. Cl.
*F01D 5/08* (2006.01)

(52) U.S. Cl. ..... 416/97 R; 415/115

(58) Field of Classification Search ..... 416/92, 416/95, 96 R, 97 R, 96 A, 97 A, 193; 415/115, 415/116

See application file for complete search history.

(56) References Cited

U.S. PATENT DOCUMENTS 3,066,910 A * 12/1962 Bluck ..... 416/92
4,257,737 A 3/1981 Andress et al.
4,278,400 A 7/1981 Yamarik et al.
4,293,275 A * 10/1981 Kobayashi et al. ..... 416/97 R
4,474,532 A 10/1984 Pazder
4,872,810 A 10/1989 Brown et al.
5,232,343 A 8/1993 Butts
5,328,331 A 7/1994 Bunker et al.
5,344,283 A * 9/1994 Magowan et al. ..... 415/115
5,382,135 A * 1/1995 Green ..... 416/97 R
5,484,258 A 1/1996 Isburgh et al.
5,674,050 A 10/1997 Hall et al.
5,690,472 A 11/1997 Lee
5,702,232 A 12/1997 Moore
5,720,431 A 2/1998 Sellers et al.
5,931,638 A 8/1999 Krause et al.
6,017,189 A * 1/2000 Judet et al. ..... 416/97 R
6,071,075 A 6/2000 Tomita et al.
6,120,249 A 9/2000 Hultgren et al.
6,174,133 B1 1/2001 Bunker
6,190,130 B1 2/2001 Fukue et al.
6,196,799 B1 3/2001 Fukue et al.
6,402,470 B1 6/2002 Kvasnak et al.
6,402,471 B1 * 6/2002 Demers et al. ..... 416/97 R
6,416,284 B1 * 7/2002 Demers et al. ..... 416/97 R
6,478,535 B1 11/2002 Chung et al.
6,478,537 B2 11/2002 Junkin
6,491,496 B2 12/2002 Starkweather
6,607,356 B2 8/2003 Manning et al.
6,705,836 B2 3/2004 Bourriaud et al.
6,916,150 B2 7/2005 Liang
6,923,620 B2 8/2005 Tiemann
6,981,840 B2 1/2006 Lee et al.
7,011,502 B2 3/2006 Lee et al.
7,059,825 B2 6/2006 Magowan et al.
7,090,461 B2 8/2006 Liang
7,104,757 B2 9/2006 Gross
7,186,089 B2 * 3/2007 Liang ..... 416/193 A (Continued)

*Primary Examiner*—Igor Kershteyn

(57) ABSTRACT

A blade is provided for a gas turbine. The blade comprises a main body comprising a cooling fluid entrance channel; a cooling fluid collector in communication with the cooling fluid entrance channel; a plurality of side channels extending through an outer wall of the main body and communicating with the cooling fluid collector and a cooling fluid cavity; a cooling fluid exit channel communicating with the cooling fluid cavity; and a plurality of exit bores extending from the cooling fluid exit channel through the main body outer wall.

16 Claims, 11 Drawing Sheets

U.S. PATENT DOCUMENTS

| | | | |
|---|---|---|---|
| 2002/0150474 | A1 | 10/2002 | Balkcum, III et al. |
| 2005/0058545 | A1 | 3/2005 | Cardenas |
| 2005/0095118 | A1 | 5/2005 | Liang |
| 2005/0095119 | A1 | 5/2005 | Liang |
| 2005/0265835 | A1 | 12/2005 | Liang |
| 2005/0265837 | A1 | 12/2005 | Liang |
| 2005/0281667 | A1 | 12/2005 | Liang |
| 2005/0281671 | A1 | 12/2005 | Liang |
| 2006/0002788 | A1 | 1/2006 | Liang |
| 2006/0056967 | A1 | 3/2006 | Liang |
| 2006/0093484 | A1 | 5/2006 | Liang |
| 2006/0153679 | A1 | 7/2006 | Liang |
| 2006/0222494 | A1 | 10/2006 | Liang |

* cited by examiner

BLADE FOR A GAS TURBINE

This invention was made with U.S. Government support under Contract Number DE-FC26-05NT42644 awarded by the U.S. Department of Energy. The U.S. Government has certain rights to this invention.

FIELD OF THE INVENTION

The present invention relates to a blade for a turbine of a gas turbine engine and, more preferably, to a blade having an improved cooling system.

BACKGROUND OF THE INVENTION

A conventional combustible gas turbine engine includes a compressor, a combustor, and a turbine. The compressor compresses ambient air. The combustor combines the compressed air with a fuel and ignites the mixture creating combustion products defining a working gas. The working gas travels to the turbine. Within the turbine are a series of rows of stationary vanes and rotating blades. Each pair of rows of vanes and blades is called a stage. Typically, there are four stages in a turbine. The rotating blades are coupled to a shaft and disc assembly. As the working gas expands through the turbine, the working gas causes the blades, and therefore the shaft and disc assembly, to rotate.

Combustors often operate at high temperatures that may exceed 2,500 degrees Fahrenheit. Typical combustor configurations expose turbine vanes and blades to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine blades comprise a root, a platform and an airfoil that extends outwardly from the platform. The airfoil is ordinarily composed of a tip, a leading edge or end, and a trailing edge or end. Most blades typically contain internal cooling channels forming a cooling system. The cooling channels in the blades may receive air from the compressor of the turbine engine and pass the air through the blade. The cooling channels often include multiple flow paths that are designed to maintain the turbine blade at a relatively uniform temperature.

Conventional turbine blades have many different designs of internal cooling systems. While many of these conventional systems have operated successfully, the cooling demands of turbine engines produced today have increased. Thus, an internal cooling system for turbine blades as well as vanes having increased cooling capabilities is needed.

SUMMARY OF THE INVENTION

In accordance with a first aspect of the present invention, a blade is provided for a gas turbine. The blade comprises a main body comprising a cooling fluid entrance channel; a cooling fluid collector in communication with the cooling fluid entrance channel; a plurality of side channels extending through an outer wall of the main body and communicating with the cooling fluid collector and a cooling fluid cavity; a cooling fluid exit channel communicating with the cooling fluid cavity; and a plurality of exit bores extending from the cooling fluid exit channel through the main body outer wall.

The main body may define an airfoil, a platform and a root. The outer wall of the main body may define at least portions of the airfoil, the platform and the root. The airfoil preferably includes a tip, a base, a leading edge and a trailing edge.

At least a substantial portion of the cooling fluid collector is located in the airfoil and the side channels extend from the cooling fluid collector toward the root.

Preferably, the cooling fluid entrance channel extends through the root and the platform into the airfoil and is positioned near the leading edge of the airfoil.

The main body may further comprise a partition extending through the root, the platform and a substantially portion of the airfoil such that it terminates just before the airfoil tip. The partition and a leading edge portion of the outer wall of the main body may define the cooling fluid entrance channel.

The main body may further comprise a floor and a separating wall. The floor may extend between opposing middle portions of the main body outer wall and be positioned at or near the platform. The separating wall may extend from the floor to the airfoil tip and further extend between the middle portions of the main body outer wall. The cooling fluid collector may be defined by the floor, the separating wall, the opposing middle portions of the main body outer wall extending from the floor to the airfoil tip and a portion of the partition.

The main body may further comprise at least one dividing wall extending from the floor toward the tip of the airfoil so as to terminate just before the airfoil tip. The at least one dividing wall separates the cooling fluid collector into a plurality of cooling fluid collector cavities.

The cooling fluid cavity may be defined at least in part by a root portion of the partition, the floor, and a section of a root portion of the outer wall of the main body.

The cooling fluid exit channel may be defined at least in part by the separating wall, and a trailing edge section of the outer wall of the main body.

The platform may include at least one internal cooling passage which communicates with one of the side channels and terminates at an opening on a side of the platform adjacent the root.

The at least one internal cooling passage may comprise first and second main cooling passages. The first cooling passage may extend from a first one of the side channels and terminate at a corresponding opening on the side of the platform adjacent the root and near the leading edge of the airfoil. The second cooling passage may extend from a second one of the side channels and terminate at a corresponding opening on the side of the platform adjacent the root and near the trailing edge of the airfoil.

The at least one internal cooling passage may further comprise first and second secondary cooling passages. The first secondary cooling passage may extend from the first main cooling passage and terminate at a corresponding opening on the side of the platform adjacent the root and near the leading edge of the airfoil. The second secondary cooling passage may extend from the second main cooling passage and terminate at a corresponding opening on the side of the platform adjacent the root and near the trailing edge of the airfoil.

In accordance with a second aspect of the present invention, a blade is provided for a gas turbine. The blade may comprise an airfoil, a platform and a root. The airfoil may include an airfoil cooling fluid entrance and at least one mid-airfoil cooling fluid channel communicating with the airfoil cooling fluid entrance. The platform may comprise at least one internal cooling passage communicating with the at least one mid-airfoil cooling fluid channel and terminating at an opening on a side of the platform.

The at least one mid-airfoil cooling fluid channel may comprise at least one first mid-airfoil cooling fluid channel and at least one second mid-airfoil cooling fluid channel.

The at least one internal cooling passage may comprise first and second main cooling passages. The first main cooling passage may extending from the first mid-airfoil cooling fluid channel and terminate at a corresponding opening on a side of the platform adjacent the root and near the leading edge of the airfoil. The second main cooling passage may extend from the second mid-airfoil cooling fluid channel and terminate at a corresponding opening on the side of the platform adjacent the root and near the trailing edge of the airfoil.

The at least one internal cooling passage may further comprise first and second secondary cooling passages.

DETAILED DESCRIPTION OF THE INVENTION

Figure 1:
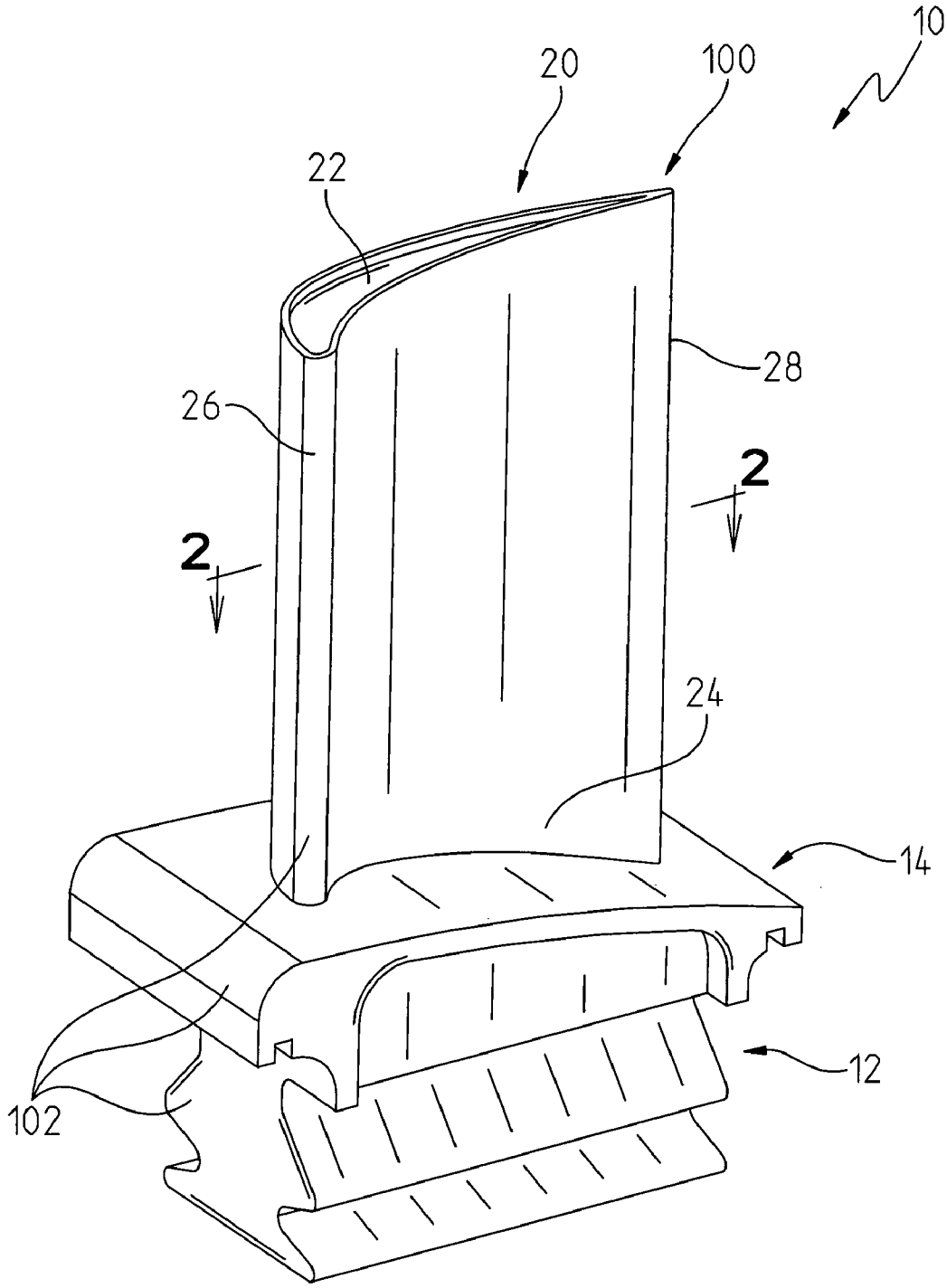
FIG. 1 is a perspective view of a blade constructed in accordance with a first embodiment of the present invention.

Referring now to FIG. 1, a blade 10 constructed in accordance with a first embodiment of the present invention is illustrated. The blade 10 is adapted to be used in a gas turbine (not shown) of a gas turbine engine (not shown). Within the gas turbine are a series of rows of stationary vanes and rotating blades. Typically, there are four rows of blades in a gas turbine. It is contemplated that the blade 10 illustrated in FIG. 1 may define the blade configuration for a second row of blades in the gas turbine.

The blades are coupled to a shaft and disc assembly. Hot working gases from a combustor (not shown) in the gas turbine engine travel to the rows of blades. As the working gases expand through the turbine, the working gases cause the blades, and therefore the shaft and disc assembly, to rotate.

Figure 2:
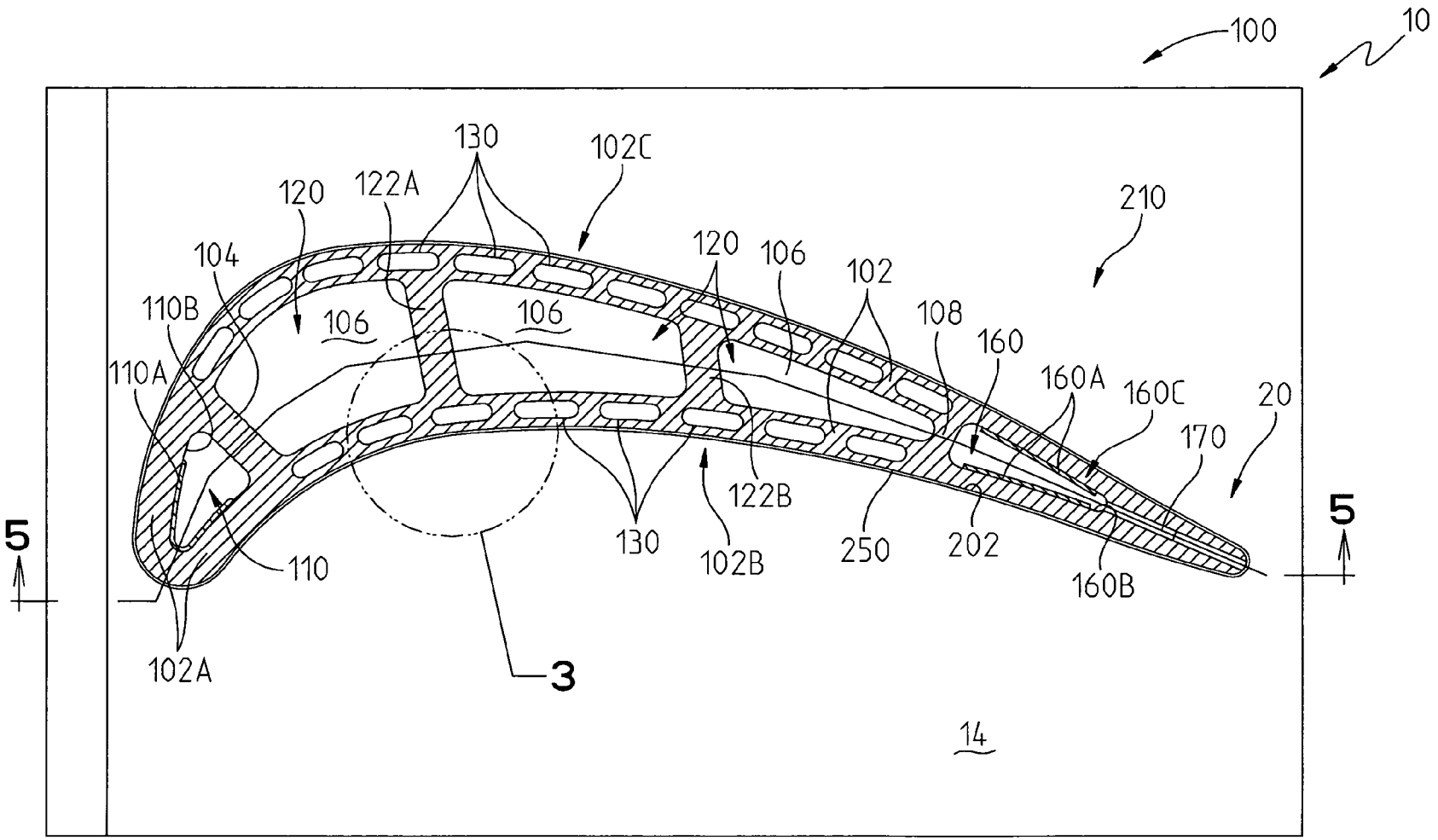
FIG. 2 is a view taken along view line 2-2 in FIG. 1.

The blade 10 is defined by a main body 100, which comprises an attachment portion or a root 12, a platform 14 integral with the root 12 and an airfoil 20 formed integral with the platform 14, see FIGS. 1 and 2. The root 12 functions to couple the blade 10 to the shaft and disc assembly (not shown) in, the gas turbine (not shown). An outer wall 102 of the main body 100 defines portions of the root 12, the platform 14 and the airfoil 20. The airfoil 20 preferably includes a tip 22, a root section or a base 24, a leading edge 26 and a trailing edge 28, see FIG. 1. The main body 100 may be formed as a single integral unit from a material such as a metal alloy 247 via a conventional casting operation.

Figure 3:
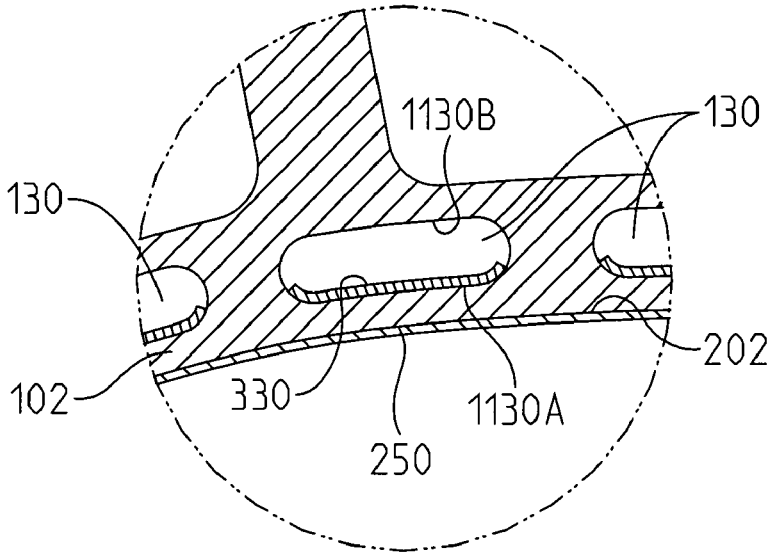
FIG. 3 is an enlarged view of the section labeled 3 in FIG. 2.
Figure 6:
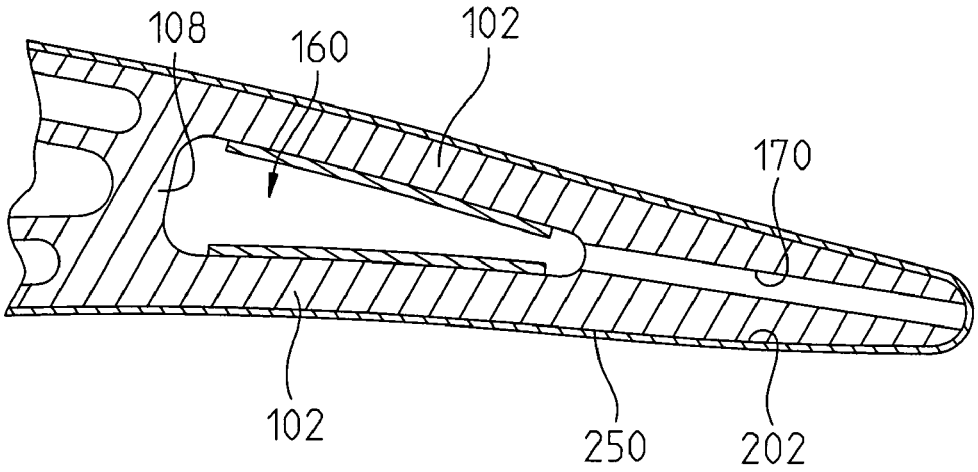
FIG. 6 is a view taken along view line 6-6 in FIG. 4.

A conventional thermal barrier coating 250 is provided on an outer surface 202 of the outer wall 102, see FIGS. 2 and 3.

The main body 100 comprises a cooling fluid entrance channel 110, a cooling fluid collector 120 communicating with the cooling fluid entrance channel 110, a plurality of near outer surface channels or side channels 130 communicating with the cooling fluid collector 120, a cooling fluid cavity 150 communicating with the side channels 130, a cooling fluid exit channel 160 communicating with the cooling fluid cavity 150 and a plurality of exit bores 170 communicating with the cooling fluid exit channel 160. A plate 200 is provided over an opening 101 in the main body 100 to the cooling fluid cavity 150 so as to block off or seal the opening 101, see FIG. 5.

Figure 5:
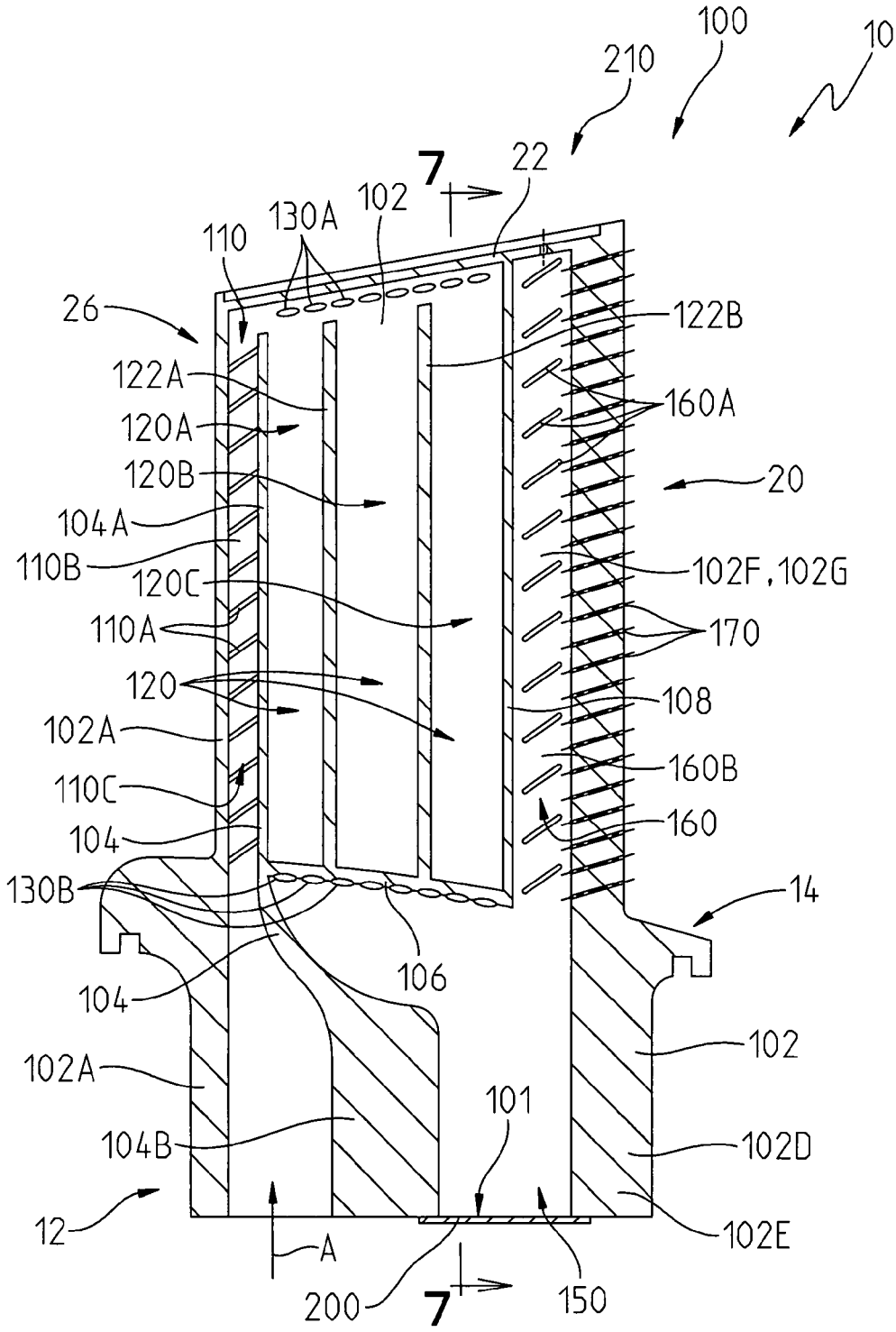
FIG. 5, is a view taken along view line 5-5 in FIG. 2.

In the illustrated embodiment, the cooling fluid entrance channel 110 extends through the root 12 and the platform 14 into the airfoil 20 and is positioned near the leading edge 26 of the airfoil 20, see FIG. 5. A plurality of protrusions 110A extend outwardly from an inner surface 110B of an airfoil portion 110C of the channel 110, see FIGS. 2 and 5. The protrusions 110A provide additional surface area on the inner surface 110B upon which a cooling fluid contacts, thereby increasing heat transfer from the main body 100 to the cooling fluid.

The side channels 130 (also referred to herein as mid-airfoil cooling fluid channels) are provided in opposing first and second middle portions 102B and 102C of the main body outer wall 102. Each side channel 130 has an entrance 130A and an exit 130B. Channel entrances 130A are located near the airfoil tip 22 and communicate with the cooling fluid collector 120. The channel exits 130B are positioned at or near the platform 14 and communicate with the cooling fluid cavity 150, see FIGS. 5 and 7. A portion 1130A of an inner surface 1130B of each side channel 130 near the outer surface 202 of the outer wall 102 may comprise a textured or rough surface 330, see FIG. 3. The textured surface 330 provides additional surface area on the inner surface 1130B upon which a cooling fluid contacts, thereby increasing heat transfer from the main body outer wall 102 to the cooling fluid. The textured surface 330 may be defined by small fins, pins, concaved dimples, and the like.

The main body 100 may further comprise a partition 104 extending through the root 12, the platform 14 and a substantial portion of the airfoil 20 such that it terminates just before the airfoil tip 22, see FIG. 5. The partition 104 and a leading edge portion 102A of the outer wall 102 of the main body 100 define the cooling fluid entrance channel 110, see FIG. 2.

Figure 4:
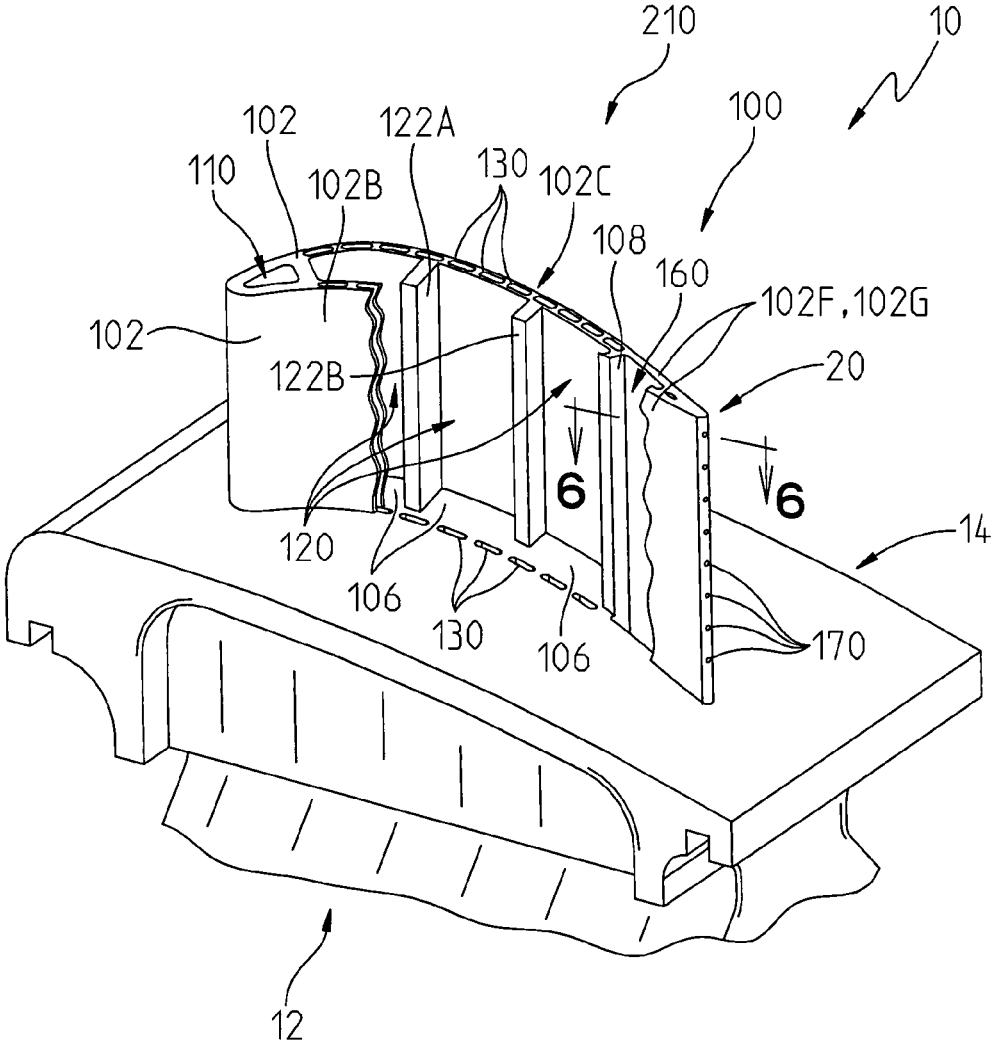
FIG. 4 is a perspective view partially in section with a portion removed of the blade illustrated in FIG. 1.

The main body 100 may further comprise a floor 106 and a separating wall 108, see FIGS. 2, 4 and 5. The floor 106 may extend between the opposing first and second middle portions 102B and 102C of the main body outer wall 102 and is positioned at or near the platform 14, see FIGS. 2 and 4. The side channels 130 extend through the floor 106, see FIG. 5. The separating wall 108 may extend from the floor 106 to the airfoil tip 22 so as to make sealing contact with the airfoil tip 22, see FIG. 5. The separating wall 108 also extends between the first and second middle portions 102B and 102C of the main body outer wall 102. In the illustrated embodiment, the cooling fluid collector 120 is defined by the floor 106, the separating wall 108, the first and second opposing middle portions 102B and 102C of the main body outer wall 102 extending from the floor 106 to the airfoil tip 22 and an upper portion 104A of the partition 104, see FIGS. 4 and 5.

In the illustrated embodiment, the main body 100 additionally includes first and second dividing walls 122A and 122B extending from the floor 106 toward the tip 22 of the airfoil 20 so as to terminate just before the airfoil tip 22. The first and second dividing walls 122A and 122B separate the cooling fluid collector 120 into first, second and third cooling fluid collector cavities 120A-120C, see FIG. 5. The number of dividing walls for separating the fluid collector 120 into a plurality of cooling fluid collector cavities may be zero, one or more than two.

Figure 7:
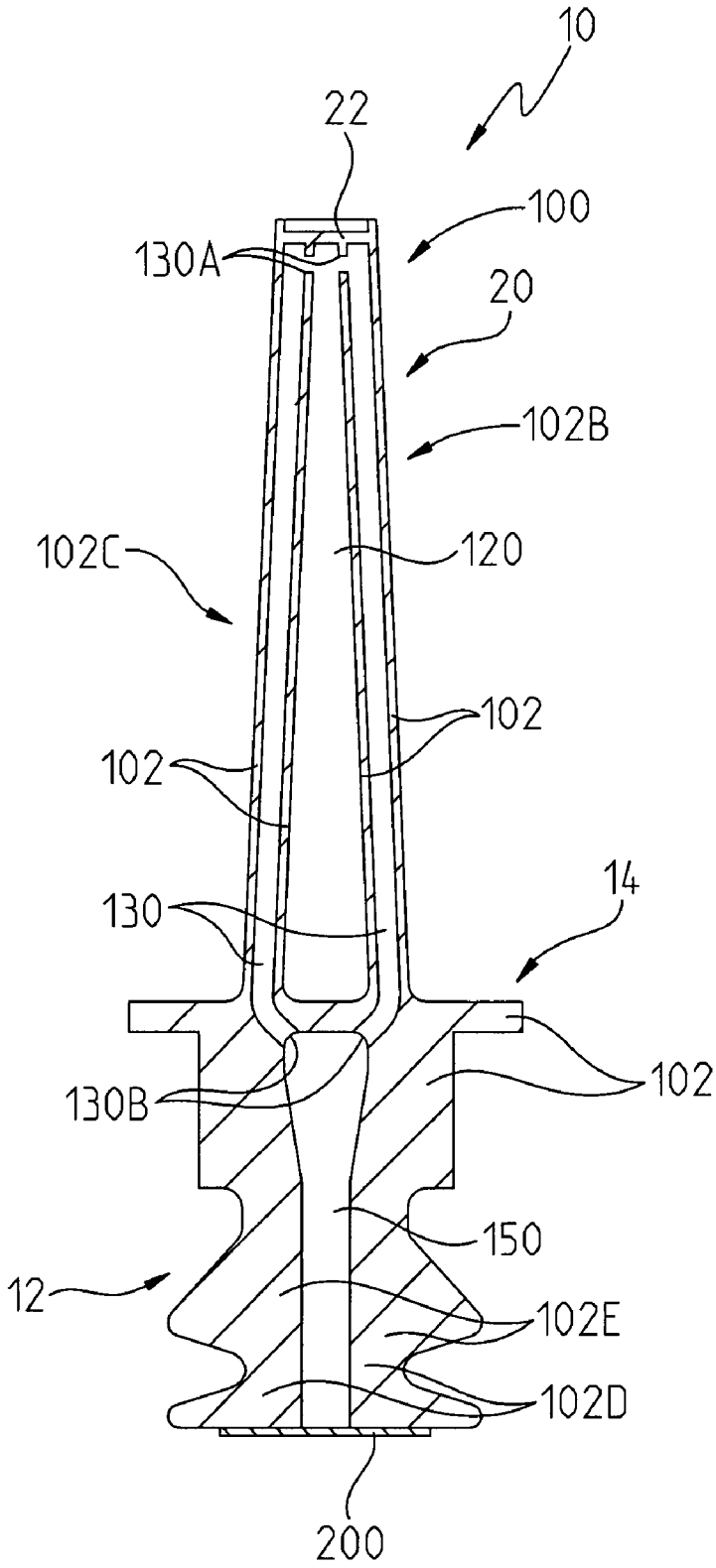
FIG. 7 is a cross sectional view taken along view line 7-7 in FIG. 5 and through a remaining portion of the blade not illustrated in FIG. 5.
Figure 8:
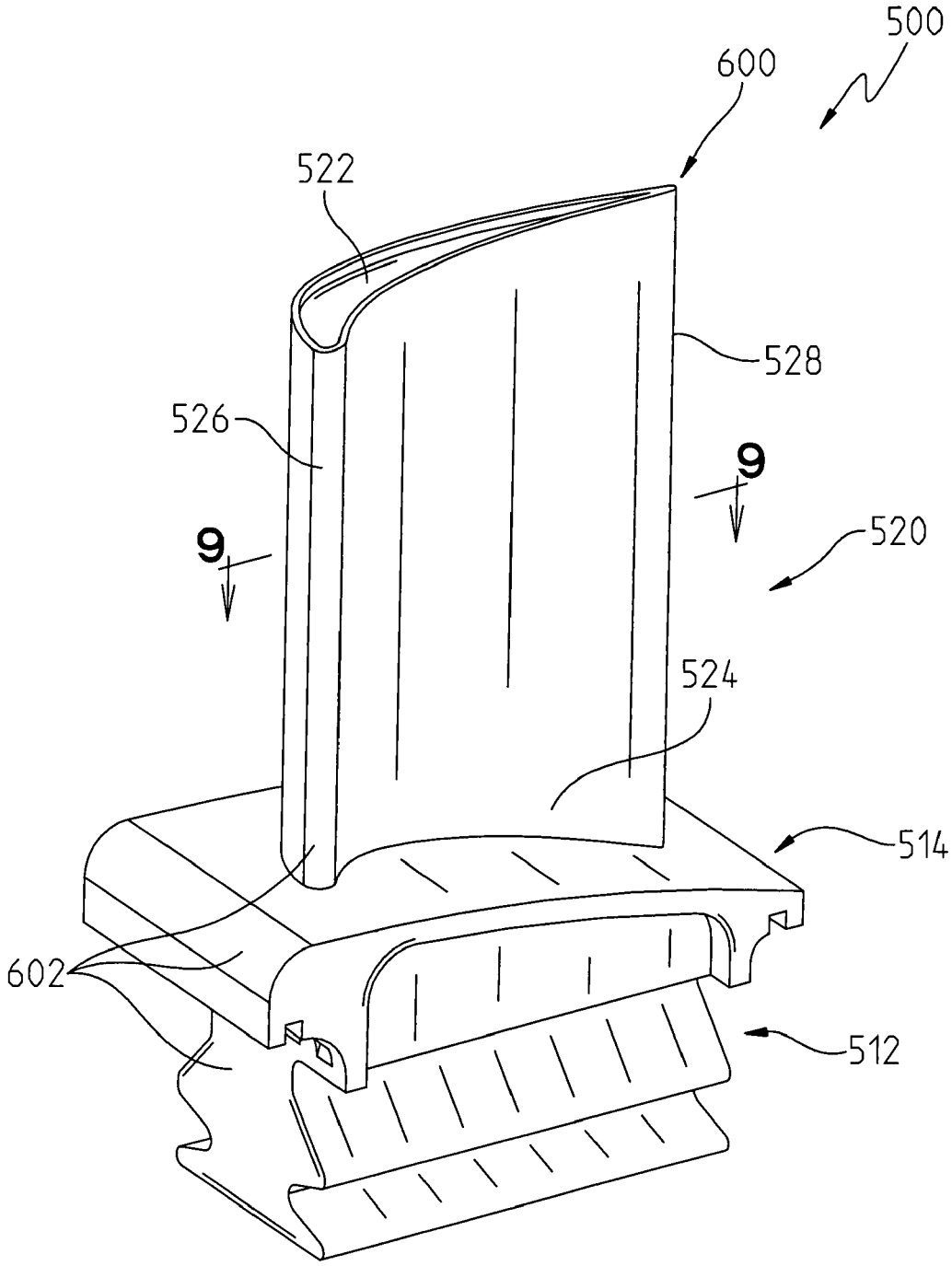
FIG. 8 is a perspective view of a blade constructed in accordance with a second embodiment of the present invention.

The cooling fluid cavity 150 may be defined by a root portion 104B of the partition 104, the floor 106, and a trialing edge section 102E of a root portion 102D of the outer wall 102 of the main body 100, see FIGS. 5 and 7.

The cooling fluid exit channel 160 may be defined by the separating wall 108, and a trailing edge section 102F of an airfoil portion 102G of the outer wall 102 of the main body 100, see FIGS. 4 and 5. A plurality of protrusions 160A extend outwardly from an inner surface 160B of the channel 160, see FIGS. 2 and 5. The protrusions 160A provide additional surface area on the inner surface 160B upon which a cooling fluid contacts, thereby increasing heat transfer from the main body 100 to the cooling fluid.

A cooling fluid, such as air or steam, is supplied under pressure in the direction of arrow A in FIG. 5 to the cooling fluid entrance channel 110. The cooling fluid may be supplied by the combustor (not shown) of the gas turbine engine via conventional supply structure (not shown) extending to the cooling fluid entrance channel 110.

The cooling fluid moves through the cooling fluid, entrance channel 110 and, as such, causes heat to be convectively transferred from the leading edge 26 of the airfoil 20 to the cooling fluid. After passing through the cooling fluid entrance channel 110, the cooling fluid passes into the cooling fluid collector 120. From the cooling fluid collector 120, the cooling fluid enters the side channels 130 via the entrances 130A. As the cooling fluid passes through the side channels 130, heat is convectively transferred from the first and second middle portions 102B and 102C of the main body outer wall 102 to the cooling fluid. After exiting the side channels 130, the cooling fluid moves into the cooling fluid cavity 150. From the cavity 150, the cooling fluid moves into the cooling fluid exit channel 160 and leaves the blade 10 via the exit bores 170. Heat is convectively transferred to the cooling fluid from the trailing edge 28 of the airfoil 20 as the cooling fluid passes through the exit channel 160 and the exit bores 170. As is apparent from the above description and FIG. 5, the cooling fluid entrance channel 110, the cooling fluid collector 120, the side channels 130, the cooling fluid cavity 150, the cooling fluid exit channel 160 and the exit bores 170 define a serpentine path through the blade 10 along which the cooling fluid moves as it passes through the blade 10.

The cooling fluid entrance channel 110, the cooling fluid collector 120, the side channels 130, the cooling fluid cavity 150, the cooling fluid exit channel 160 and the exit bores 170 define a blade cooling system 210. It is believed that the blade cooling system 210 will function in a very efficient manner so as to allow the blade 10 to be used in high temperature applications where a cooling fluid is provided at a low flow rate to the cooling system 210.

In accordance with a second embodiment of the present invention, as illustrated in FIGS. 8-10, 10A and 10B, a blade 500, adapted to be used in a gas turbine (not shown) of a gas turbine engine (not shown), is provided. The blade 500 is defined by a main body 600, which comprises a root 512, a platform 514 integral with the root 512 and an airfoil 520 formed integral with the platform 514, see FIGS. 8 and 9. An outer wall 602 of the main body 600 defines portions of the root 512, the platform 514 and the airfoil 520. The airfoil 520 includes a tip 522, a base 524, a leading edge 526 and a trailing edge 528, see FIG. 8. The main body 600, may be formed as a single integral unit from a material such as a metal alloy 247 via a conventional casting operation.

Figure 9:
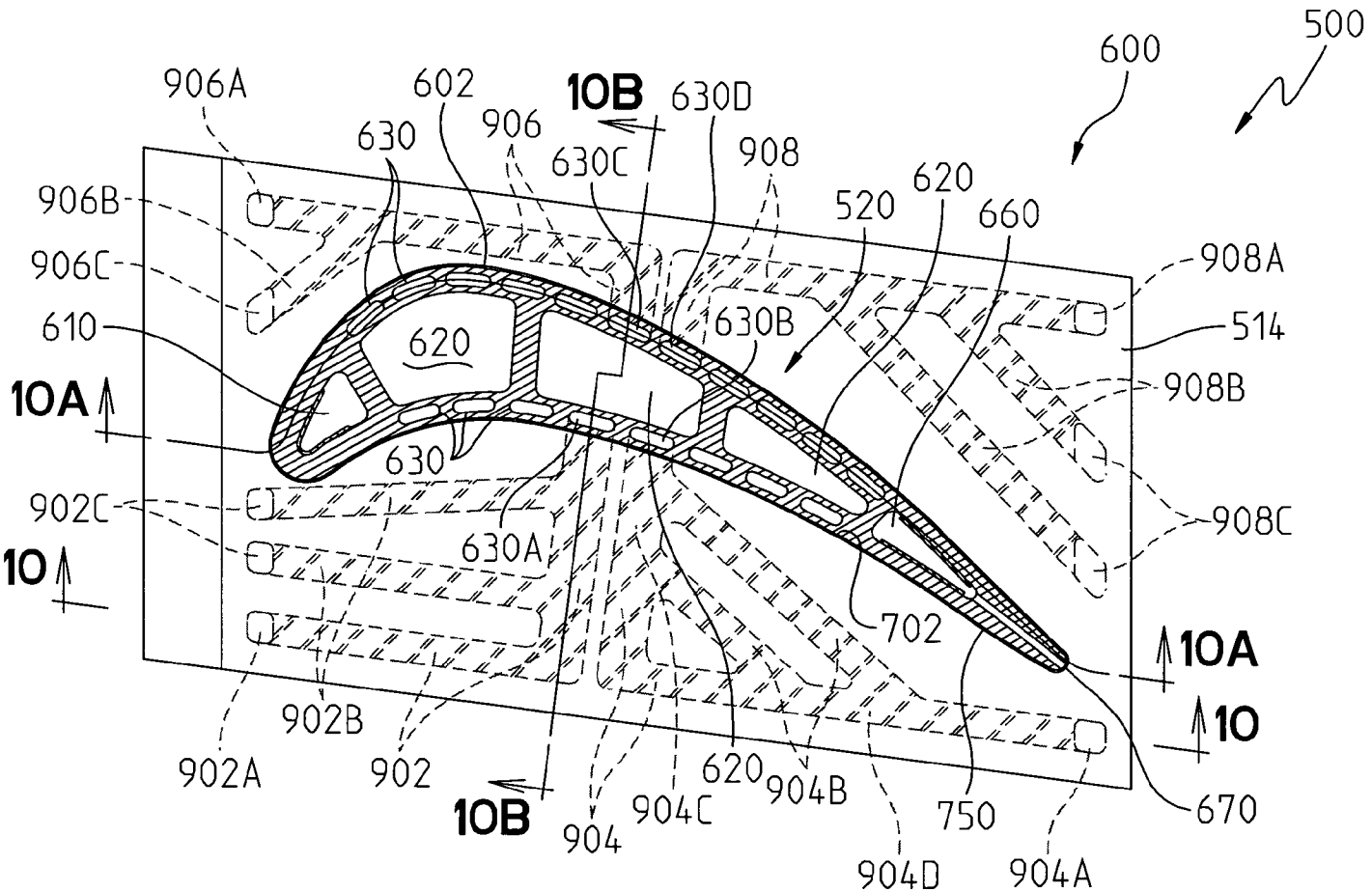
FIG. 9 is a view taken along view line 9-9 in FIG. 8.
Figure 10:
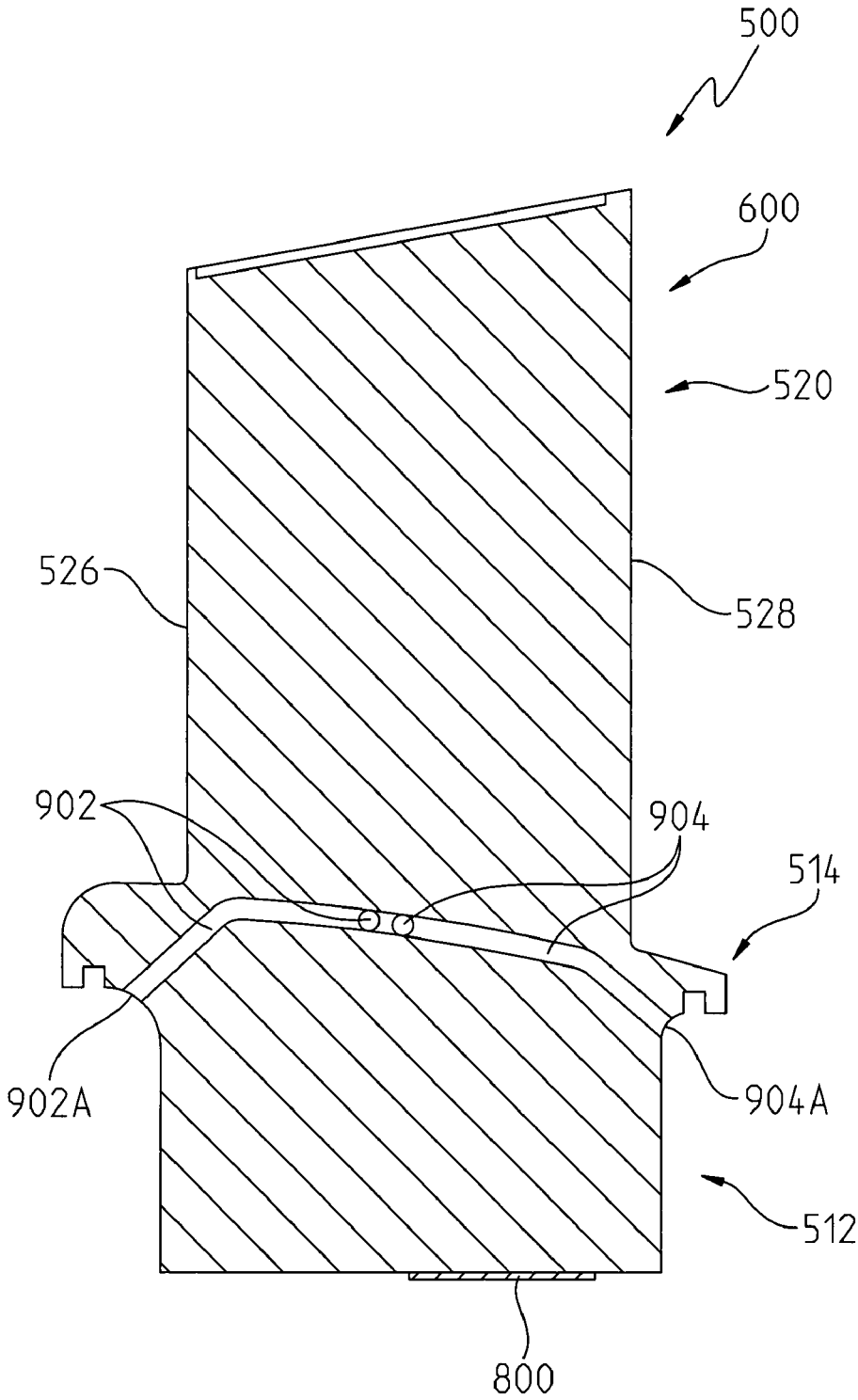
FIG. 10 is a view taken along view line 10-10 in FIG. 9.
Figure 10A:
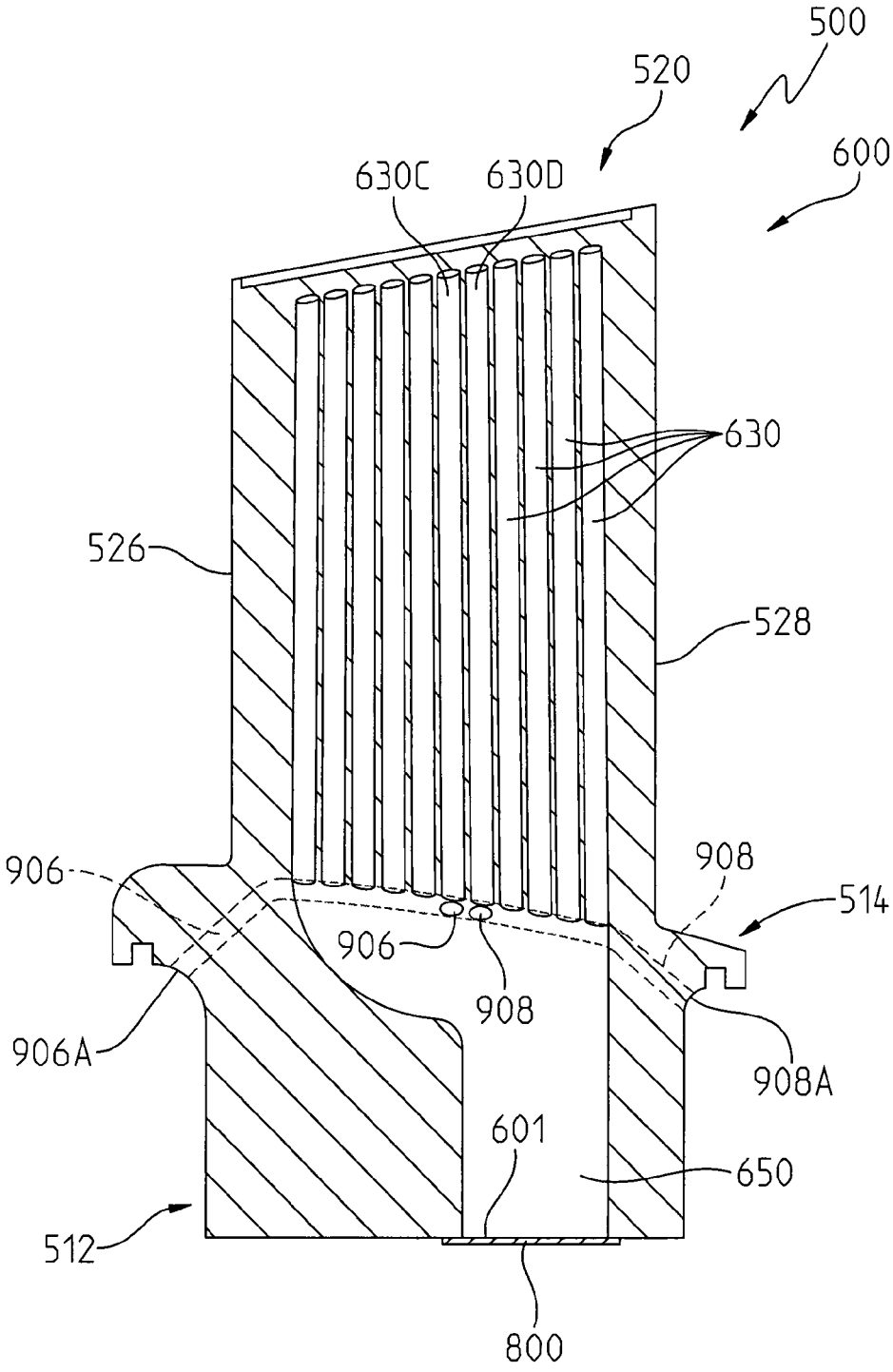
FIG. 10A is a view taken along view line 10A-10A in FIGS. 9 and 10B.
Figure 10B:
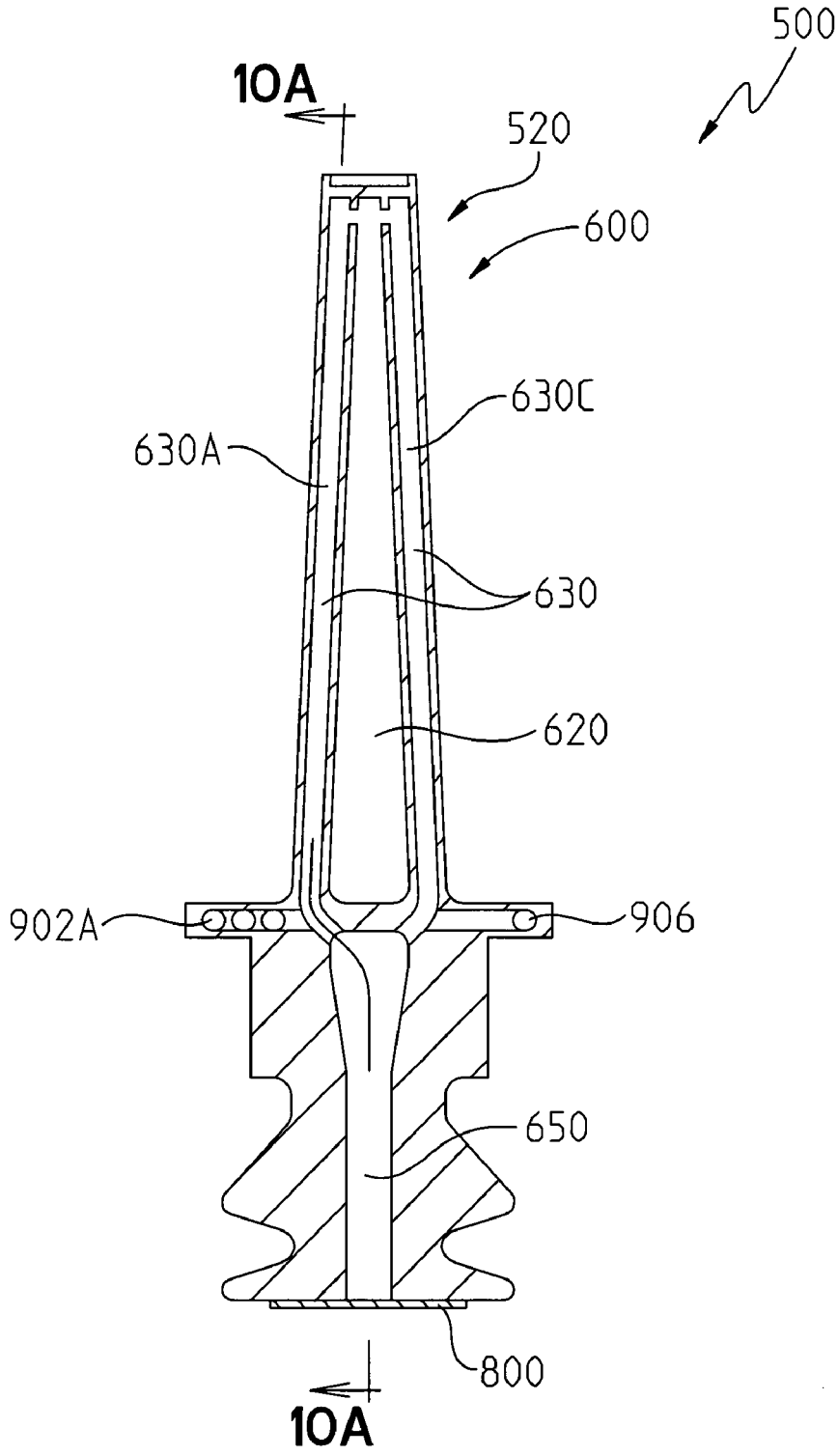
FIG. 10B is a view taken along view line 10B-10B in FIG. 9.

A conventional thermal barrier coating 750 is provided on an outer surface 702 of the outer wall 602, see FIG. 9.

Just as in the embodiment illustrated in FIGS. 1-7, the main body 600 comprises a cooling fluid entrance channel 610, a cooling fluid collector 620 communicating with the cooling fluid entrance channel 610, a plurality of side channels 630 communicating with the cooling fluid collector 620, a cooling fluid cavity 650 communicating with the side channels 630, a cooling fluid exit channel 660 communicating with the cooling fluid cavity 650 and a plurality of exit bores 670 communicating with the cooling fluid exit channel 660. A plate 800 is provided over an opening 601 in the main body 600 to the cooling fluid cavity 650 so as to block off or seal the opening 601, see FIG. 10A.

In this embodiment, the platform 514 comprises first, second, third and fourth main cooling passages 902, 904, 906 and 908, see FIG. 9. The first cooling passage 902 extends within the platform 514 from a first side channel 630A to an exit 902A on the side of the platform 514 adjacent the root 512 and near the leading edge 526 of the airfoil 520, see FIGS. 9 and 10. The second cooling passage 904 extends within the platform 514 from a second side channel 630B to an exit 904A on the side of the platform 514 adjacent the root 512 and near the trailing edge 528 of the airfoil 520, see FIGS. 9 and 10. The third cooling passage 906, extends within the platform 514 from a third side channel 630C to an exit 906A on the side of the platform 514 adjacent the root 512 and near the leading edge 526 of the airfoil 520, see FIGS. 9 and 10A. The fourth cooling passage 908 extends within the platform 514 from a fourth side channel 630D to an exit 908A on the side of the platform 514 adjacent the root 512 and near the trailing edge 528 of the airfoil 520.

The platform 514 further includes first, second, third and fourth secondary cooling passages 902B, 904B, 906B and 908B. The first secondary cooling passages 902B extend from the first main cooling passage 902 and terminate at a corresponding opening 902C on the side of the platform 514 adjacent the root 512 and near the leading edge 526 of the airfoil 520, see FIG. 9. The second secondary cooling passages 904B extend between first and second legs 904C and 904D of the second main cooling passage 904. The third secondary cooling passage 906B extends from the third main cooling passage 906 and terminates at an opening 906C on the side of the platform 514 adjacent the root 512 and near the leading edge 526 of the airfoil 520, see FIG. 9. The fourth secondary cooling passages 908B extend from the fourth main cooling passage 908 and terminate at a corresponding opening 908C on the side of the platform 514 adjacent the root 512 and near the trailing edge 528 of the airfoil 520, see FIG. 9.

As the cooling fluid passes through the main and secondary cooling passages 902, 902B, 904, 904B, 906, 906B, 908, 908B heat is convectively transferred from the platform 514 to the cooling fluid.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blade for a gas turbine comprising:

a main body comprising:

a cooling fluid entrance channel;

a cooling fluid collector in communication with said cooling fluid entrance channel;

a plurality of side channels extending through an outer wall of said main body and communicating with said cooling fluid collector and a cooling fluid cavity;

a cooling fluid exit channel communicating with said cooling fluid cavity; and a plurality of exit bores extending from said cooling fluid exit channel through said main body outer wall.

2. The blade as set forth in claim 1, wherein said main body defines an airfoil, a platform and a root, said outer wall of said main body defines at least portions of said airfoil, said platform and said root, and said airfoil including a tip, a base, a leading edge and a trailing edge.

3. The blade as set forth in claim 2, wherein at least a substantial portion of said cooling fluid collector is located in said airfoil and said side channels extend from said cooling fluid collector toward said root.

4. The blade as set forth in claim 2, wherein said cooling fluid entrance channel extends through said root and said platform into said airfoil and is positioned near said leading edge of said airfoil.

5. The blade as set forth in claim 4, wherein said main body further comprises a partition extending through said root, said platform and a substantially portion of said airfoil such that it terminates just before said airfoil tip, said partition and a leading edge portion of said outer wall of said main body defining said cooling fluid entrance channel.

6. The blade as set forth in claim 5, wherein said main body further comprises:

a floor extending between opposing middle portions of said main body outer wall and positioned at or near said platform;

a separating wall extending from said floor to said airfoil tip and extending between said middle portions of said main body outer wall; and said floor, said separating wall, said opposing middle portions of said main body outer wall and a portion of said partition defining said cooling fluid collector.

7. The blade as set forth in claim 6, wherein said main body further comprises at least one dividing wall extending from said floor toward said tip of said airfoil so as to terminate just before said airfoil tip and separating said cooling fluid collector into a plurality of cooling fluid collector cavities.

8. The blade as set forth in claim 6, wherein said cooling fluid cavity is defined at least in part by a root portion of said partition, said floor, and a section of a root portion of said outer wall of said main body.

9. The blade as set forth in claim 8, wherein said cooling fluid exit channel is defined at least in part by said separating wall, and a trailing edge section of said outer wall of said main body.

10. The blade as set forth in claim 2, wherein said platform includes at least one internal cooling passage which communicates with one of said side channels and terminates at an opening on a side of said platform adjacent said root.

11. The blade as set forth in claim 10, wherein said at least one internal cooling passage comprises:

a first main cooling passage extending from a first one of said side channels and terminating at a corresponding opening on said side of said platform adjacent said root and near said leading edge of said airfoil; and a second main cooling passage extending from a second one of said side channels and terminating at a corresponding opening on said side of said platform adjacent said root and near said trailing edge of said airfoil.

12. The blade as set forth in claim 11, wherein said at least one internal cooling passage further comprises:

a first secondary cooling passage extending from said first main cooling passage and terminating at a corresponding opening on said side of said platform adjacent said root and near said leading edge of said airfoil; and a second secondary cooling passage extending from said second main cooling passage and terminating at a corresponding opening on said side of said platform adjacent said root and near said trailing edge of said airfoil.

13. A blade for a gas turbine comprising:

a root;

an airfoil including an airfoil cooling fluid entrance, at least one first mid-airfoil cooling fluid channel communicating with said airfoil cooling fluid entrance, and at least one second mid-airfoil cooling fluid channel communicating with said airfoil cooling fluid entrance; and a platform comprising:

a first main cooling passage communicating with said first mid-airfoil cooling fluid channel and extending from said first mid-airfoil cooling fluid channel and terminating at a corresponding opening on a side of said platform adjacent said root and near a leading edge of said airfoil;

a second main cooling passage communicating with said second mid-airfoil cooling fluid channel and extending from said second mid-airfoil cooling fluid channel and terminating at a corresponding opening on said side of said platform adjacent said root and near a trailing edge of said airfoil;

a first secondary cooling passage extending from said first main cooling passage and terminating at a corresponding opening on said side of said platform adjacent said root and near said leading edge of said airfoil; and a second secondary cooling passage extending from said second main cooling passage and terminating at a corresponding opening on said side of said platform adjacent said root and near said trailing edge of said airfoil.

14. A blade for a gas turbine comprising:

an airfoil including an airfoil cooling fluid entrance and at least one mid-airfoil cooling fluid channel communicating with said airfoil cooling fluid entrance;

a platform comprising:

at least one main cooling passage communicating with said at least one mid-airfoil cooling fluid channel and terminating at a corresponding opening on a side of said platform; and at least one secondary cooling passage extending from said main cooling passage and terminating at a corresponding opening on said side of said platform; and a root.

15. The blade as set forth in claim 14, wherein said at least one mid-airfoil cooling fluid channel comprises at least one first mid-airfoil cooling fluid channel and at least one second mid-airfoil cooling fluid channel.

16. The blade as set forth in claim 14, wherein said opening of said at least one main cooling passage terminates on said side of said platform adjacent said root and near one of:

a leading edge of said airfoil; and a trailing edge of said airfoil.

* * * * *